US009552801B2

(12) United States Patent
Adnitt et al.

(10) Patent No.: US 9,552,801 B2
(45) Date of Patent: Jan. 24, 2017

(54) ELECTRONIC MUSIC INSTRUMENT, SYSTEM AND METHOD FOR CONTROLLING AN ELECTRONIC MUSIC INSTRUMENT

(71) Applicant: NATIVE INSTRUMENTS GmbH, Berlin (DE)

(72) Inventors: Tim Adnitt, London (GB); Dinos Vallianatos, Berlin (DE)

(73) Assignee: Native Instruments GmbH, Berlin (DE)

( * ) Notice: Subject to any disclaimer, the term of this patent is extended or adjusted under 35 U.S.C. 154(b) by 0 days.

(21) Appl. No.: 14/474,763

(22) Filed: Sep. 2, 2014

(65) Prior Publication Data

US 2016/0063978 A1 Mar. 3, 2016

(51) Int. Cl.

| | |
|---|---|
| ***G10H 7/00*** | (2006.01) |
| ***G10H 1/38*** | (2006.01) |
| ***G10H 1/26*** | (2006.01) |

(52) U.S. Cl.

CPC ..... *G10H 1/38* (2013.01); *G10H 1/26* (2013.01); *G10H 2210/395* (2013.01); *G10H 2210/565* (2013.01)

(58) Field of Classification Search

CPC ..... G10H 1/0066; G10H 2240/056; G10H 2240/311; G10H 1/00; G10H 2240/021; G10H 2240/011; G06F 2221/2107; G10C 5/005; G10G 1/02

See application file for complete search history.

(56) References Cited

U.S. PATENT DOCUMENTS

| | | | | |
|---|---|---|---|---|
| 6,449,661 | B1 * | 9/2002 | Fujishima | G10H 1/0066 710/5 |
| 7,915,514 | B1 * | 3/2011 | Shrem | G10H 1/0075 84/615 |
| 8,865,994 | B2 * | 10/2014 | Okano | G10H 1/0066 84/609 |
| 2001/0015121 | A1 * | 8/2001 | Okamura | G10H 1/0066 84/609 |
| 2002/0023530 | A1 * | 2/2002 | Komano | G10H 1/0008 84/622 |
| 2004/0206226 | A1 * | 10/2004 | Negoescu | G10H 7/006 84/600 |
| 2005/0190199 | A1 * | 9/2005 | Brown | G09B 15/00 345/600 |
| 2010/0005509 | A1 * | 1/2010 | Peckover | G06F 21/10 726/3 |
| 2010/0313736 | A1 * | 12/2010 | Lenz | G09B 15/02 84/477 R |

(Continued)

*Primary Examiner* — Marlon Fletcher
(74) *Attorney, Agent, or Firm* — Fox Rothschild LLP

(57) ABSTRACT

An electronic music instrument comprises an input configured for receiving at least one note event from an input device having a plurality of input elements configured for generating at least one note event when activated; a software module configured for including: at least one instrument plugin configured for defining sounding note events and non-sounding control events, and at least one play assistant module, wherein the software module is further configured for at least one of the group comprising excluding the control events from being processed by play assistant functions and excluding play assistant functions generating control events.

17 Claims, 2 Drawing Sheets

(56) References Cited

U.S. PATENT DOCUMENTS

| | | | | |
|---|---|---|---|---|
| 2013/0087037 | A1* | 4/2013 | Dreher | G10H 1/0066 84/645 |
| 2014/0053712 | A1* | 2/2014 | Dreher | G10H 1/0033 84/645 |
| 2016/0063978 | A1* | 3/2016 | Adnitt | G10H 1/34 84/744 |
| 2016/0063980 | A1* | 3/2016 | Buese | G10H 1/344 84/744 |

* cited by examiner

ELECTRONIC MUSIC INSTRUMENT, SYSTEM AND METHOD FOR CONTROLLING AN ELECTRONIC MUSIC INSTRUMENT

FIELD OF THE INVENTION

The present invention relates to an electronic music instrument, a system comprising the electronic music instrument and a data processing device, a method for controlling an electronic music instrument, a computer program and a computer-readable storage medium.

BACKGROUND

Keyboard instruments and their corresponding software provide so-called play assistants or play assistant modules to enhance the player's comfort. These are software modules that intercept or influence the MIDI (Musical Instrument Digital Interface) digital signals or note events generated by the player on the keyboard's keybed and alter the event stream in such a way that the player can achieve musically complex playing styles while not having to be an expert musician, e.g. harmonizing the played notes or arpeggiation of notes.

A so-called scale mode is known from Apple's GarageBand App for the iPad. The app shows a Marimba-like interface to the user, excluding notes that don't fit a certain scale and root note setting. In particular the black keys are suppressed and not depicted on the screen. The black keys are also called intermediate semitones. In the scale mode, when connecting a standard MIDI keyboard to the iPad, all keys are, however, functioning normally.

Further, many electronic music instruments like MIDI keyboard-controlled synthesizers or samplers provide the player with a so-called control octave, which is a range of one or more keys for switching parameters inside the instrument's software. In most cases, this control octave uses low notes to not interfere with the common note range of the instrument. The player commonly plays the instrument with his right hand. By pressing one or more keys, a digital signal or key event corresponding to the one or more played notes is generated. With the left hand the player plays keys of the control octave, thereby controlling the "sound", i.e. switching parameters in the instrument software that affect the sound. The control keys are usually non-sounding keys, i.e. no sound is produced by pressing them alone.

Thereby arises the problem that functions of the play assistant module and of the control functionality might interfere and trigger unwanted states of the electronic music instrument.

BRIEF SUMMARY OF THE INVENTION

This problem is solved according to the invention by an electronic music instrument according to claim 1, a system comprising the electronic music instrument and a data processing device according to claim 8, a method for controlling an electronic music instrument according to claim 12, a computer program according to claim 16 and a computer-readable storage medium according to claim 17, respectively.

According to an aspect of the present invention an electronic music instrument comprises an input configured for receiving at least one note event from an input device having a plurality of input elements configured for generating at least one note event corresponding to a particular note event when activated, wherein the note event includes at least one of a sounding note event and a non-sounding control event; a software module configured for including: at least one instrument plugin configured for defining sounding note events and non-sounding control events, and at least one play assistant module, wherein the software module is further configured for at least one of the group comprising excluding the control events from being processed by play assistant functions and excluding play assistant functions generating control events. The electronic music instrument provides an independent instrument host, i.e. the software module that provides different play assistant modules and instrument plugins to the user. This architecture has the advantage of high flexibility. The software module supervises both functionalities and prevents mutually interferences or invocations which may result in undesired states of the electronic music instrument. Hardware coding or a control instance like an arbitrator or a software routine may ensure separation of these functional blocks. As a result, unwanted state changes of the instrument are avoided.

The electronic music instrument as well as the input device may be a keyboard, synthesizer, DJ controller, pad controller, matrix controller, 4×4 controller, step sequencer or the like configured for generating and/or affecting notes or sounds and note or sound events, respectively. The electronic music instrument and the input device may be a single instrument or device. The input element may depend on the type or setup of the instrument and may include at least one of the group consisting of a key, a button, a pad or the like. The input elements may be arranged and/or mapped in a chromatic sequence or chromatic scale. The input elements may be arranged in a common functional group.

Alternatively, the software module may be a computational device like for example a DSP (digital signal processor) and the play assistant modules and the instrument plugins may be realized in hardware or software. This arrangement is then based on hardware or a combination of hardware and software depending on the demands to the electronic music instrument.

The electronic music instrument is configured for excluding the control events from play assistant functions (e.g. an arpeggiator or chorder). Then, the control events may be passed through a play assistant module or function of the electronic music instrument unprocessed. In other words, the input element range of the control input elements or control keys are excluded from the event generation in the play assistant functions. An arpeggiator for example can not create notes from control or non-sounding input elements. This way, a state change of the instrument is not accidentally triggered. At the same time the intended state change induced by operation of a control input element can not trigger the arpeggiator and generate audible events. In other words, the control events are then excluded from being processed in the play assistant modules, and the control events are excluded from the event generation in the play assistant module. For example, the arpeggiator cannot create notes that are a control event so as to not accidentally trigger a state change in the electronic music instrument. At the same time the intended state change through operating an input element in the control input element range cannot trigger the arpeggiator and generate further audible events.

The software module may be a software synthesizer or a sample-based instrument. As the synthesizer generates the electric sound signals or waveforms it is advantageous to include the play assistant module and the instrument plugin into the software synthesizer. In this way, the necessary calculations can be performed more efficiently.

The input may be connected to the play assistant module, the instrument plugin may be configured for creating a list including control events and for providing the list to the play assistant module and the play assistant module may be configured for comparing the note event with the list and for processing the note event if the note event is not a control event or for passing the note event to the instrument plugin if the note event is a control event. Here, both parties, i.e. the module and the plugin interact directly with each other thereby reducing complexity of communication. The play assistant module decides whether the incoming note event is a sounding note event to be processed by the play assistant module or whether the incoming note event is a non-sounding control event to be processed by the instrument plugin or by the software module. This decision prevents that a control event triggers a play assistant function accidentally which could cause an unwanted state of the instrument or a sound not intended to be sounded.

The electronic music instrument may further comprise an arbitrator configured for prohibiting interference between the instrument plugin and the play assistant module. In this case, an independent arbitrator supervises communication of the two blocks, i.e. the module and the plugin. Such architecture improves flexibility and eases an implementation of several blocks. Here, the arbitrator decides whether the incoming note event is a sounding note event to be passed to the play assistant module or whether the incoming note event is a non-sounding control event to be passed to the instrument plugin or to the software module.

The play assistant module may be configured for generating a note event, comparing the generated note event with the list of control events and for passing the generated note event to the instrument plugin if the generated note event is not a control event or for discarding the generated note event if the generated note event is a control event. Here, the output of a play assistant module is supervised to prevent that undesired control events are provided to the instrument plugin. Thereby, it is prevented that a play assistant function triggers a control event which could also distort the sound and set the instrument into an undesired state.

The software module may be configured for mapping the control events to low note events corresponding to low notes. This allows to pin or fix the control input elements or control events to distinct input elements of the input device even for different transposition states of the input device or its input elements. Thereby, the player can freely transpose input elements or range of input elements while one or more control input elements always keep their control function. Depending on the size of the input device i.e. the number of input elements, one or more ranges of input elements can be present. The control input elements can directly adjoin each other or can be dispersed over the input device.

The at least one play assistant module may include at least one of a harmonizer module, a chorder module, a scaler module and an arpeggiator module. For novice players these helpful functions can improve the style of play. The harmonizer, chorder and scaler modules add or change events in time with the user-generated events so that after being processed by the scaler module, all notes played by the user fit a certain musical scale. The harmonizer adds additional notes to each of the notes played by the user to fit a certain chord scheme. The chorder module plays chords from a lookup table based on the activated or depressed input element. The arpeggiator module can create additional and especially differently timed note events so that e.g. the currently depressed input elements are sequenced and not played simultaneously.

According to another aspect of the present invention an electronic music system comprises an electronic music instrument as described before; a data processing device in connection with the electronic music instrument; and an input device having a plurality of input elements configured for generating a note event corresponding to a particular note event when pressed and being connected with the data processing device. Such a system can for example be implemented with benefit in the music industry. In this case the electronic music instrument may be a keyboard instrument or a mixer while the data processing device may be a digital audio workstation.

The data processing device may be configured for executing the software module of the electronic music instrument. The data processing device such as a digital audio workstation is usually the center of an electronic music system. Therefore, it is beneficial to execute or run the software module on this device as all inputs and connections are available.

The input device may comprise visual indicators each arranged at an input element and configured for indicating at least one control input element corresponding each to a control event. By looking at the input elements of the input device in front of him the user or player can see which input elements are mapped as the control input elements. The player's experience is greatly enhanced as the control functions are directly evident from the input device. No looks towards a control screen of a computer or the like are necessary to assess the control functions. As a first advantage it is possible to mark control input elements. Second, the function or the functional group can also be indicated for each input element.

The input device may comprise an RGB LED for each input element, the RGB LEDs being configured for color coding the sounding input elements and the control input elements. The color coding adds a further step in convenience for the player. With one view the player can identify sounding input elements (e.g. blue) and control or function input elements in other colors. This enhanced control input element visualization enables the player to perform without having to memorize the input element-functioning mapping. Further, the colors of the input elements can be matched with screen representations of software for example of a digital audio workstation.

According to another aspect of the present invention a method for controlling an electronic music instrument including a software module including at least one instrument plugin and at least one play assistant module, comprises the steps of:

generating a list of non-sounding control events;

receiving a note event;

comparing the note event with the list of control events; and passing the note event to the play assistant module if the note event is not a control event or passing the note event to the instrument plugin if the note event is a control event.

Here, an incoming note event like for example from a MIDI keyboard is examined whether it belongs to a list of control events which are used for setting up the electronic music instrument and not for being sounded or recorded. In case of a control event the note event is passed to the instrument plugin or a software module hosting the instrument plugin for being applied to a setting or a parameter. The control event is not passed to the play assistant module. Thereby, the control input elements are excluded from play assistant functions in order to prohibit erroneous operation of the instrument. By excluding the control input elements from play assistant functions it is ensured that one input element does not belong to different functionalities, i.e. the control function and the play assistant function. Separating these functions prevents unwanted states of the instrument or of the functions.

The method may further comprise the steps of:

generating a note event in the play assistant module;

comparing the generated note event with the list of control events; and passing the generated note event to the instrument plugin if the generated note event is not a control event or discarding the generated note event if the generated note event is a control event.

Hereby it is ensured that a play assistant module is not accidentally invoking a control function by generating a control event and outputting it to the instrument plugin. The output of the play assistant module is supervised and generated control events are discarded. Such a supervision improves stability of the electronic music instrument.

The control events may be mapped to low note events corresponding to low notes. For example, a control octave is provided to the player of the input device. In reaction to the current transposition state the software module remaps or reassigns the currently selected lowest octave to be the control octave. The player can control the sound with the control octave on the left side of the input device and play the instrument on the neighboring octave or octaves on the right side of the input device.

The control input elements generating control events may be visually indicated. Such a visual indication allows for a quick orientation of the instrument's or input device's set up.

At least one parameter of the group of hue, saturation and brightness is adaptable for the visual indication of the control input elements generating control events. These parameters offer a wide range of presentation or display for coding the input elements of the input device.

According to a further aspect of the present invention a computer program which enables a data processing device, after the computer program has been loaded into memory means of the data processing device, to carry out a method as described above. Such a computer program may be provided for downloading in a data or communication network. The computer program may be downloaded via the internet to computer like for example a digital audio workstation (DAW).

According to an even further aspect of the present invention a computer-readable storage medium on which a program is stored which enables a data processing device, after the program has been loaded into memory means of the data processing device, to carry out a method as described above.

BRIEF DESCRIPTION OF THE DRAWINGS

Exemplary embodiments of the invention will now be described in more detail with reference to the Figures which show in FIG. 1 a schematic diagram of a system of an electronic music instrument and a digital audio workstation.

DETAILED DESCRIPTION

Figure 1:
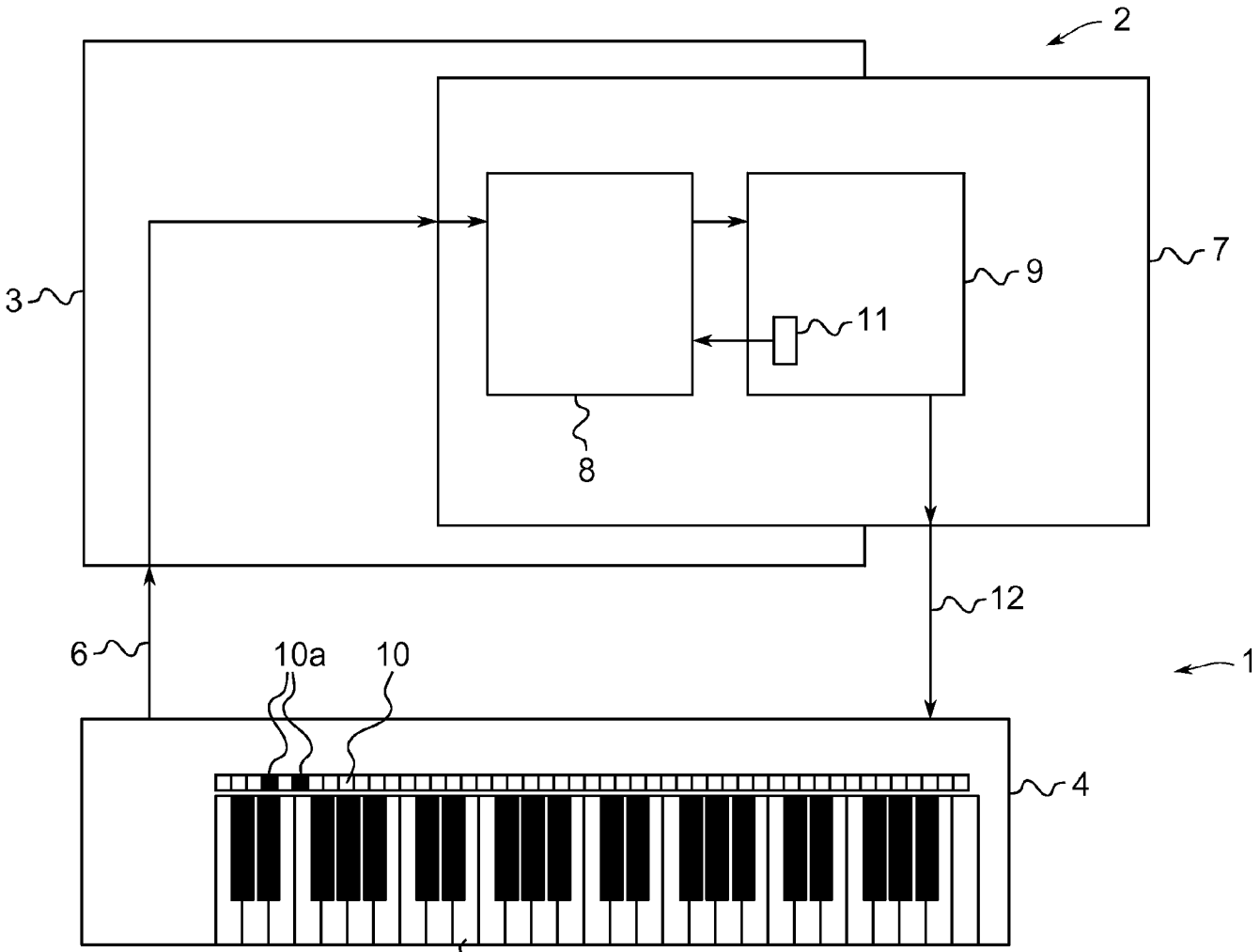

FIG. 1 shows a system 1 with an electronic music instrument 2 and a data processing device 3 as a block diagram. The electronic music instrument may further be a keyboard, synthesizer, DJ controller, pad controller, 4×4 controller, step sequencer or the like configured for generating and/or affecting note or sound events. In the following examples, the electronic music instrument 2 may be a keyboard instrument or a synthesizer. Here, the system 1 or the electronic music instrument 2 has a hardware keyboard 4 with a plurality of keys 5. The keyboard 4 may for example include 25, 49 or 61 keys. Other instruments may include keys and/or other input elements like for example buttons of a button matrix or pads of a pad style controller. The following explanations are not only applicable to the explained keyboard, but are valid as well for other electronic music instruments.

Each key 5 generates a signal or note event when it is pressed by a player. As a key 5 is present as an input element, the note event may also be designated as key event. Via a communication link 6 like a data line or a bus system the signal is provided to a data processing device 3. The data processing device 3 may be a DSP, a chip or the like in an enclosure common to the keyboard 4 or a separate device like a computer or a digital audio workstation (DAW). The signal, the communication link 6, protocols and/or interfaces may be compatible to the MIDI standard, USB standard (Universal Serial Bus) or other standards known from computers or music instruments.

The data processing device 3 runs or executes a software module 7 to which the signal is provided. The software module 7 includes one or more play assistance functions 8 and at least one instrument plugin 9.

The software module 7 may encompass further modules, routines, functions or plugins. According to the signals from the keyboard 5 the software module 7 generates or computes an output signal to be recorded and or played. The functions of the software module 7 may be influenced by internal and/or external modulation engines, oscillators, sequencers, envelope followers or the like.

When working with the electronic music instrument 2 or playing an instrument like the electronic music instrument 2, one or more software programs, instruments, routines or plugins are used or executed in serial or parallel. Such software can be executed on the electronic music instrument 2, the data processing device 3 and/or further devices.

To each key 5 of the keyboard 4*a* visual indicator 10 is assigned. The visual indicators 10 are arranged directly at the respective keys 5. Here, the visual indicators 10 are located at ends of the keys 5 distant to a player. In other words, the visual indicators 10 are arranged in the vicinity to the pivot of the keys 5. As an alternative the keys 5 itself may be illuminated.

The visual indicator 10 may include a light emitting diode (LED) advantageously an RGB LED capable of displaying red, green and blue light. An LED can be directly arranged at a key 5 or inside the keyboard 4. In latter case a light guide is present guiding the light to a display element in front of the key 5. The visual indicator 10 may be adaptable with regard to hue, saturation and/or brightness.

The visual indicator 10 indicates information with regard to the respective key 5. The visual indicator 10 shows whether a key belongs to a sounding key or a non-sounding control key. Here, two visual indicators 10*a* are turned on exemplarily thereby marking the respective keys as control keys.

By pressing a sounding key a note event corresponding to a note or a sequence of notes is generated by the keyboard 4. By pressing a non-sounding control key control functions or parameters of the instrument 2, the keyboard 4, the data processing device 3 and/or the software module 7 are altered or set.

Inside the instrument plugin 9 or optionally inside the software module 7 a list 11 of control events or control note events (if at least one key is present) is generated. The list 11 is provided to the keyboard 4 via a communication link 12. The communication link 12 may be the same link as communication link 6.

The list 11 is further provided to the play assistant module 8 for consideration. During play of the keyboard 4 note events (sounding note events and non-sounding control events) are provided to the software module 7 and then to the play assistant module 8.

Inside the play assistant module 8 the received note event is compared with or matched against the list 11 in order to filter control events. If the received note event is a control event it will be passed unaltered or unprocessed to the instrument plugin 9 or alternatively to the software module 7 for further prosecution. In other words, the control event is not invoking any play assistant function. The control event may alter settings of the instrument plugin 9 to change it's sound for example. Such control information can be looped back via interface or link 12 to the keyboard 4 for displaying it with the help of one or more visual indicators 10.

If the received note event is no control event it will be processed inside the play assistant module 8. Then, one or more play assistant functions may be activated by the play assistant module 8. The received note event is influenced or processed and one or more note events are generated and provided to the instrument plugin 9 for further processing. It could also be the case no play assistant function is associated with the received note event. Then, the play assistant module 8 may provide this received note event unchanged to the instrument plugin 9.

The play assistant module 8 may include functions like harmonizer, chorder and scaler modules which add or change events in time with the user-generated events so that after being processed by the scaler module, all notes played by the user fit a certain musical scale. The harmonizer adds additional notes to each of the notes played by the user to fit a certain chord scheme. The chorder module plays chords from a lookup table based on the depressed key. The arpeggiator module can create additional and especially differently timed note events so that e.g. the currently depressed keys are sequenced and not played simultaneously.

The play assistant module 8 generates a note event by itself when processing a received note event from the keyboard 4. This generated note event might be a control event. In order to prevent outputting such a control event to the instrument plugin for further processing in which case an undesired start of a control function would occur, the list 11 is utilized again to control or supervise the output of the play assistant module 8.

Thus, the generated note event is compared with the list of control events and the generated note event is only passed to the instrument plugin 9 if the generated note event is not a control event. If on the other hand, the generated note event is a control event it will be discarded and not provided to the instrument plugin 9.

Figure 2:
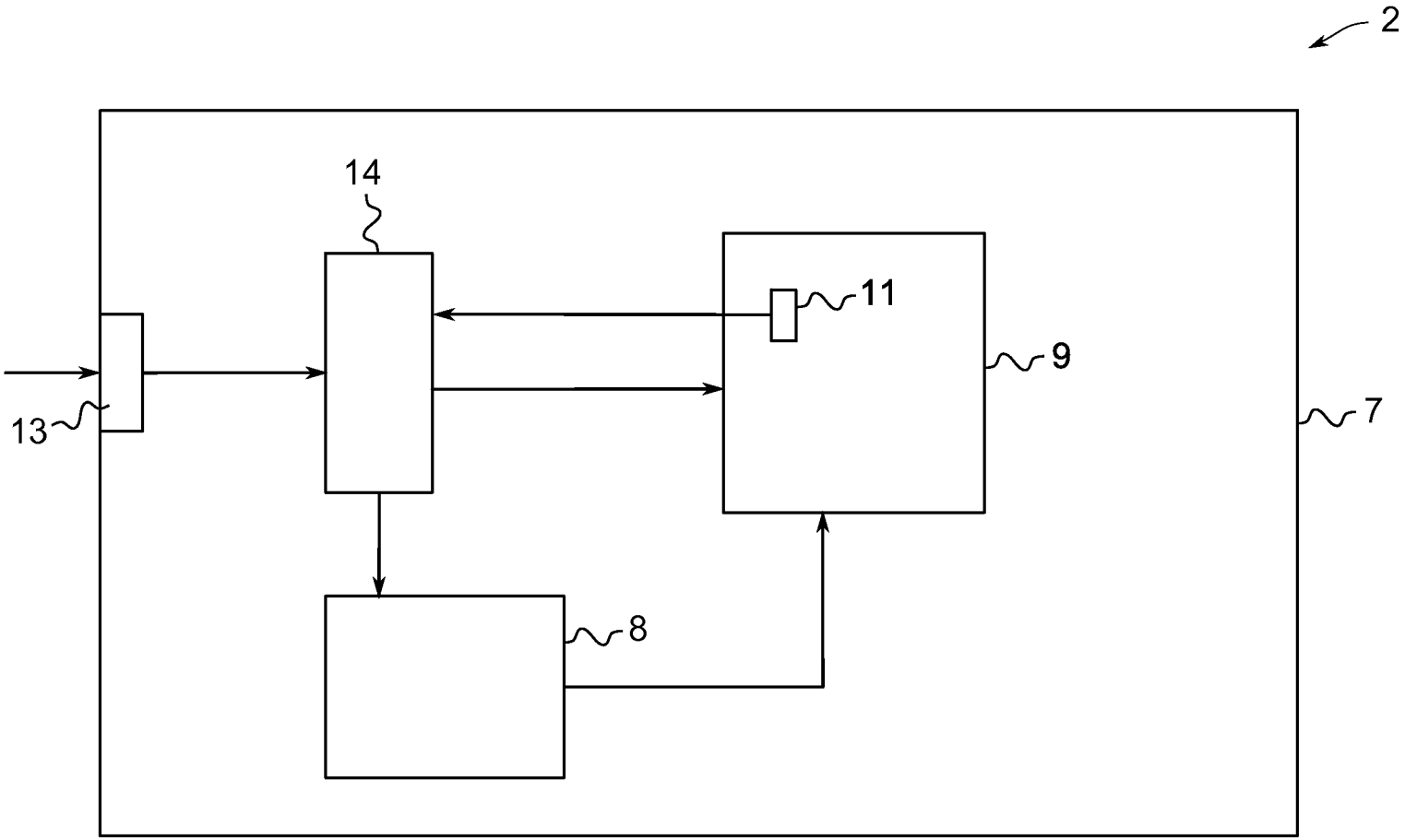
FIG. 2 a schematic diagram of the electronic music instrument.

According to FIG. 2 an embodiment of the instrument 2 is shown. The software module 7 may be executed in the data processing device 3 and/or keyboard 4 of FIG. 1. Alternatively, reference sign 7 may indicate a computational device like a DSP in which the play assistant module 8 and the instrument plugin 9 are integrated, either in hardware and/or software.

An interface or input 13 of the software module 7 receives a note event generated by the keyboard 4 or by further devices. The received note event is provided to an arbitrator 14. The arbitrator 14 is further provided with the list 11 of control events from the instrument plugin 9.

The received note event is compared with or matched against the list 11 by the arbitrator 14 in order to filter or identify control events. If the received note event is a control event it will be passed to the instrument plugin 9 or alternatively to the software module 7 for further prosecution. The control event may alter settings of the instrument plugin 9 to change it's sound for example. Such control information can be looped back to the keyboard for displaying it with the help of one or more visual indicators.

If the received note event is no control event, i.e. a sounding note event it will be passed to the play assistant module 8. Then, one or more play assistant functions may be activated by the play assistant module 8. The received note event is influenced or processed and one or more note events are generated and provided to the instrument plugin 9 for further processing.

As described with regard to FIG. 1, the generated note event is compared with the list of control events and the generated note event is only passed to the instrument plugin 9 if the generated note event is not a control event. If on the other hand, the generated note event is a control event it will be discarded and not provided to the instrument plugin 9.

It could also be the case that no play assistant function is associated with the received note event. Then, the play assistant module 8 may provide the received note event unchanged to the instrument plugin 9. This decision may be made by the arbitrator 14 as well. Then, the note event being no control event and not being associated with a play assistant function is passed to the instrument plugin 9.

Further instrument plugins and/or play assistant modules may be integrated within software module 9. The additional blocks may be arranged in parallel to the arbitrator 14.

The invention claimed is:

1. An electronic music instrument, comprising an input receiving at least one note event from an input device having a plurality of input elements that generate the at least one note event when activated, wherein the at least one note event includes at least one of a sounding note event operative to cause output of a played note or a non-sounding control event operative to cause a change in a parameter of instrument software;

a software module comprising:

at least one instrument plugin defining sounding note events and non-sounding control events, and at least one play assistant module;

wherein the software module uses the at least one instrument plugin for at least one of the group comprising excluding the non-sounding control events from being processed by play assistant functions and excluding play assistant functions generating control events.

2. The electronic music instrument according to claim 1, wherein the input device is a keyboard having a plurality of keys generating a note event when pressed.

3. The electronic music instrument according to claim 1, wherein the software module is a software synthesizer or sample-based instrument.

4. The electronic music instrument according to claim 1, wherein the input is connected to the play assistant module, the instrument plugin creates a list including control events and provides the list to the play assistant module, and the play assistant module compares the note event with the list and processes the note event if the note event is not a control event or passes the note event to the instrument plugin if the note event is a control event.

5. The electronic music instrument according to claim 4, wherein the play assistant module generates a note event, compares the generated note event with the list of control events and passes the generated note event to the instrument plugin if the generated note event is not a control event or discards the generated note event if the generated note event is a control event.

6. The electronic music instrument according to claim 1, further comprising an arbitrator prohibiting interference between the instrument plugin and the play assistant module.

7. The electronic music instrument according to claim 1, wherein the at least one play assistant module includes at least one of a harmonizer module, a chorder module, a scaler module and an arpeggiator module.

8. An electronic music system, comprising an electronic music instrument comprising:

an input receiving at least one note event from an input device having a plurality of input elements that generate the at least one note event when activated, wherein the at least one note event includes at least one of a sounding note event operative to cause output of a played note or a non-sounding control event operative to cause a change in a parameter of instrument software, and a software module, comprising:

at least one instrument plugin defining sounding note events and non-sounding control events, and at least one play assistant module, wherein the software module uses the at least one instrument plugin for at least one of the group comprising excluding the control events from being processed by play assistant functions and excluding play assistant functions generating control events;

a data processing device in connection with the electronic music instrument; and an input device having a plurality of input elements that generate at least one note event when activated and being connected with the data processing device.

9. The electronic music system according to claim 8, wherein the data processing device executes the software module of the electronic music instrument.

10. The electronic music system according to claim 8, wherein the input device comprises visual indicators each arranged at an input element and indicates at least one control input element corresponding each to a control event.

11. The electronic music system according to claim 8, wherein the input device comprises an RGB LED for each input element, the RGB LEDs used for color coding sounding input element and control input element.

12. A method for controlling an electronic music instrument including a software module including at least one instrument plugin and at least one play assistant module, comprising the steps of:

generating a list of non-sounding control events by the at least one instrument plugin;

receiving a note event including at least one of a sounding note event operative to cause output of a played note or a non-sounding control event operative to cause a change in a parameter of instrument software;

comparing the note event with the list of non-sounding control events;

passing the note event to the play assistant module if the note event is not a control event; and passing the note event to the instrument plugin if the note event is a control event.

13. The method according to claim 12, further comprising the steps of:

generating a note event in the play assistant module;

comparing the generated note event with the list of non-sounding control events;

passing the generated note event to the instrument plugin if the generated note event is not a control event; and discarding the generated note event if the generated note event is a control event.

14. The method according to claim 12, wherein control input elements generating control events are visually indicated.

15. The method according to claim 12, wherein at least one parameter of the group of hue, saturation and brightness is adaptable for visual indication of control input elements generating control events.

16. An apparatus, comprising:

a data processing device; and a memory device having stored thereon a computer program for causing a data processing device to perform the steps comprising:

generating a list of non-sounding control events;

receiving a note event including at least one of a sounding note event operative to cause output of a played note or a non-sounding control event operative to cause a change in a parameter of instrument software;

comparing the note event with the list of non-sounding control events;

passing the note event to the play assistant module if the note event is not a control event; and passing the note event to the instrument plugin if the note event is a control event.

17. A non-transitory computer-readable storage medium having stored thereon a computer program executable by a data processing device, the computer program comprising a plurality of code sections for performing the method comprising:

generating a list of non-sounding control events;

receiving a note event including at least one of a sounding note event operative to cause output of a played note or a non-sounding control event operative to cause a change in a parameter of instrument software;

comparing the note event with the list of non-sounding control events;

passing the note event to the play assistant module if the note event is not a control event; and passing the note event to the instrument plugin if the note event is a control event.

* * * * *